United States Patent [19]

Kelsey et al.

[11] Patent Number: 4,576,306

[45] Date of Patent: Mar. 18, 1986

[54] CLOSURE FOR A CONTAINER HAVING VENT AND TETHERED MEANS

[75] Inventors: Stephen F. Kelsey, Ilford; Andrzej J. J. Juty, Harrow, both of England

[73] Assignee: Metal Box plc, England

[21] Appl. No.: 699,243

[22] Filed: Feb. 7, 1985

[30] Foreign Application Priority Data

Feb. 18, 1984 [GB] United Kingdom ..... 8404320

[51] Int. Cl.[4] ..... B65D 17/34

[52] U.S. Cl. ..... 220/271; 220/307; 220/375

[58] Field of Search ..... 220/269–271, 220/375, 307

[56] References Cited

U.S. PATENT DOCUMENTS 3,262,612 7/1966 Tabor ..... 220/307
3,998,354 12/1976 Song ..... 220/269
4,344,545 8/1982 Aschlerger et al. ..... 220/307
4,391,385 7/1983 Rausing ..... 220/270

*Primary Examiner*—George T. Hall
*Attorney, Agent, or Firm*—Diller, Ramik & Wight

[57] ABSTRACT

A plastics closure for a can end of the kind having a pouring aperture and a venting aperture comprises a first connecting member which connects a vent plug and a pouring aperture plug and is extended to form a pull tab acting directly on the vent plug. The plugs are rupturably sealed over the respective apertures of collar portions connected by a second connecting member and fitting in the venting aperture and the pouring aperture. Flexible tie means extend from the pouring aperture plug to flexible hinges joined to the venting aperture collar. When the pull tab is lifted the vent plug is torn away from the venting aperture collar to achieve dry venting before the pouring aperture plug is torn away to complete opening for pouring. The plugs are retained captive by the tie means for reclosure of the apertures.

10 Claims, 12 Drawing Figures

CLOSURE FOR A CONTAINER HAVING VENT AND TETHERED MEANS

BACKGROUND OF THE INVENTION

1. Field of the Invention

This invention relates to a closure for a container of the kind having a pouring aperture and a venting aperture in one end of the container, and more particularly but not exclusively to a closure for a can containing liquid under pressure, such as a carbonated drink or beer.

2. Description of the Prior Art

British Patent Specification No. 1,389,351 describes a can of this kind provided with an opening device moulded from a plastics material so as to have a resilient aperture or lip portion defining a pouring aperture and a smaller venting aperture aligned with the container openings, the lip portion being airtightly connected to the can end; a resilient removable portion connected to the lip portion by a hinge between adjacent ends of said portions, the removable portion carrying plugs on its undersurface which are attached in an airtight but rupturable manner to the edges of the apertures in the lip portion; and a pull tab normally located adjacent the hinge and connected to said removable portion by two legs which encircle the removable portion and are connected to its further or outer end, adjacent the periphery of the can end. In order to open the device the user lifts the pull tab and the legs transmit the force exerted on the pull tab to the outer end of the removable portion so as to rupture the plugs from the pouring aperture and the vent aperture in turn. Continued pulling thus opens the pouring aperture and then the vent aperture and the hinge allows the removable portion to be extended away from the apertures to facilitate drinking or pouring, while keeping it attached ready for reclosure by fitting the plugs on the removable portion into the apertures.

A major problem with the closure arrangement described in British Patent Specification No. 1,389,351 is that first opening is at a point near the periphery of the can end. At this point there is a risk that, if the can is slightly tilted, the liquid will be in contact with the point of first opening so that on opening gaseous pressure in the headspace will force the liquid out of the pouring aperture, putting the user at risk of getting wet and losing some of his drink. British Patent Specification No. 1,389,351 also describes an alternative opening device which comprises a lip portion defining a pouring aperture and a venting aperture; a removable portion carrying plugs on its underside closing both apertures; and a pull ring extending from the removable portion near the venting aperture. This alternative opening device gives the benefit of first opening the vent aperture near the centre of the can end, so permitting dry venting of the can before opening the pouring aperture, but no connection is provided between the lip portion and the removable portion, presumably because a hinge between the adjacent ends of these portions at their outer ends would obstruct drinking or pouring. The loose reclosure portion may easily be lost and may then become an environmental nuisance.

SUMMARY OF THE INVENTION

This invention therefore seeks to provide a closure which will permit dry venting of a container and remain captive on the container for use as a reclosure, without obstructing drinking or pouring.

This invention provides a closure for a container of the kind having a pouring aperture and a venting aperture in one end of the container, said closure being moulded in one piece of plastics material and comprising respective annular collar portions adapted to fit tightly within the said apertures, and respective plugs each attached by a rupturable section of the plastics material to the mouth of its annular collar portion to seal the respective aperture, each plug being shaped so that after breaking of the rupturable section to open the aperture the plug can be forced back into the collar portion to reseal the aperture, the two plugs being connected to one another by a connecting member which is flexibly connected to one of the collar portions so as to retain the plugs after opening of the apertures, characterised in that the connecting member is extended beyond the vent plug to form a pull tab, which is thereby connected directly to the vent plug and through the connecting member to the pouring aperture plug, and the flexible connection of the connecting member to the said one collar portion is provided by flexible tie means extending from a side or sides of the pouring aperture plug to the said collar portion.

This arrangement ensures that the vent plug is opened first to give dry venting. After opening both plugs, the tie means permit the connecting member to be moved clear of the pouring aperture but retained for reclosure.

In one embodiment the tie means comprises a single flexible tie strap extending from the pouring aperture plug along one side of the connecting member to a hinge integral with the said collar portion.

In an alternative arrangement the tie means further comprises a second flexible tie strap extending from the pouring aperture plug along the other side of the connecting member to a second hinge integral with the said collar portion.

In a second embodiment the tie means comprise a hinge portion depending from the side of the pouring aperture plug distant from the pull tab and at least one strap portion extending from the hinge below the level of the connecting member to join the venting aperture collar portion.

A second connecting member may be provided, below the first connecting member and connecting adjacent sides of the two collar portions together.

The collar portions may each be provided with a cylindrical outer surface for engagement within the respective apertures in the can end, to which they may be sealingly engaged either by snap fitting as a plug or alternatively by deforming the metal to sealingly engage with the cylindrical outer surface. Various shapes of pull tab may be used, such as a 'T' shape wider than the connecting member, or a ring shaped tab or a tab with a pair of side pieces extending to each side of the venting plug to give a larger, and therefore more comfortable, gripping area.

DETAILED DESCRIPTION OF THE DRAWINGS

Figure 1:
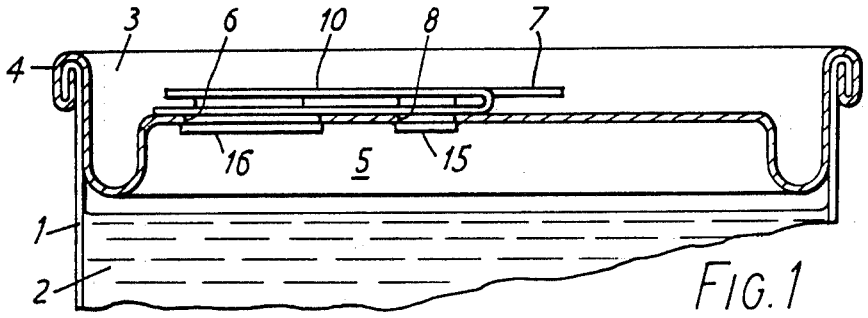
FIG. 1 is a vertical sectional view of part of a can sectioned on a diameter to show a side view of a closure according to the invention.

In FIG. 1 a can body 1 filled with a carbonated beverage 2 is closed by a can end 3 joined to the body 1 by a double seam 4. The headspace 5 between the surface of the beverage and the can end 3 contains gas under pressure. The can end has a pouring aperture 6 near the double seam 4 and a venting aperture 8 near the centre of the can end. Both apertures are closed by a closure 10 which can be opened by means of a pull tab 7.

If the can body 1 is tilted during opening, the pouring aperture 6 is likely to be immersed in beverage, so it is desirable to relieve the headspace pressure before the pouring aperture is opened. This is achieved by the closure of FIGS. 1 to 3 because raising of pull tab 7 first opens the vent aperture 8 to relieve the headspace pressure and then continued pulling opens the pouring aperture 6 while the user has time to avoid spillage.

Figure 2:
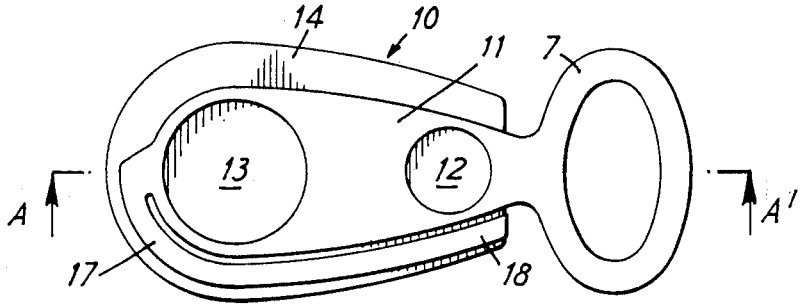
FIG. 2 is a plan view of the closure shown in FIG. 1 to a larger scale.
Figure 3:
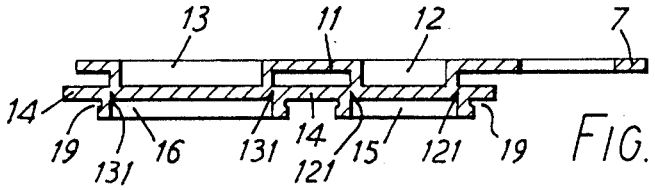
FIG. 3 is a sectional view of the closure of FIG. 2 on line A–A' as marked on FIG. 2.

As shown in FIGS. 1 to 3, the closure 10 comprises a first or connecting member 11 which connects a vent plug 12 to a pouring aperture plug 13 and extends beyond the vent plug to form the pull tab 7. A second connecting member 14, arranged substantially parallel with the first connecting member 11, connects an annular venting aperture collar 15 to an annular pouring aperture collar 16. Each plug 12,13 is sealingly engaged with its respective collar 15,16, through a rupturable section 121,131 of the plastics material of reduced thickness, so as to seal the respective aperture. The whole closure is made as a single moulding of plastics material, such as medium density polyethylene or polypropylene.

The pull tab 7 operably connects directly with the vent plug 12 so that on lifting of the pull tab 7 the vent plug 12 is torn away to open the vent aperture at a point nearer to the middle of the headspace 5 than the pouring aperture 6, to permit dry venting. Continued pulling on the pull tab tears the vent plug clear of the venting aperture collar 15 and then tears the pouring plug 13 clear of the pouring aperture collar 16.

A tie means in the form of a single strap 17 projects from the left hand side of the pouring plug 13 as seen in FIG. 2, to pass along one side of the member 11 to a flexible portion 18 which acts as a hinge to connect the strap 17 to the venting aperture collar 15. This arrangement gives adequate strap length for the plugs to be pulled well clear of the collars to permit drinking or pouring.

The collars 15,16 are each provided with a groove 19 in their cylindrical exterior surface into which frustoconical margins of metal of the can end are crushed to effect a clinched seal as is described in British Patent Specification No. 2,097,310A to which the reader is directed for a more detailed description of the method.

Figure 4:
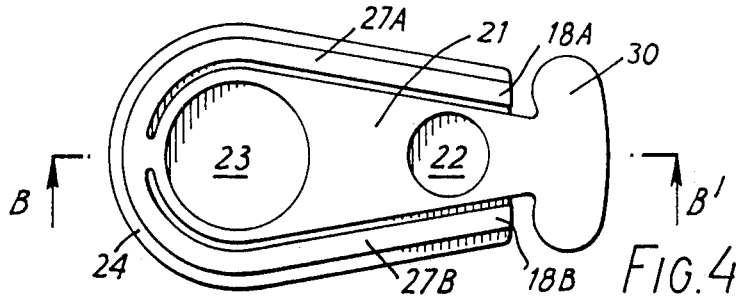
FIG. 4 is a plan view of a second embodiment of the closure of the invention.
Figure 5:
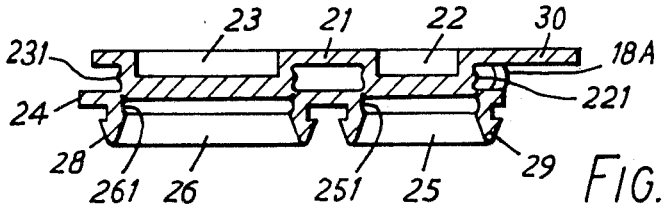
FIG. 5 is a sectional view of the closure of FIG. 4 on line B–B′ in FIG. 4.

FIGS. 4 and 5 show a second embodiment of the closure having a first connecting member 21 and second connecting member 24 which work in the same manner as the members 11 and 14 in FIGS. 2 and 3. However in FIGS. 4 and 5 the pouring aperture collar 26 and venting aperture collar 25 are provided with snap fit plug beads 28,29 respectively. The vent plug 22 and pouring plug 23 are provided with snap fit beads 221,231 for fitting into complementary recesses 251,261 in each collar when reclosing the apertures.

In FIG. 4 the closure can be seen to have two side straps 27A,27B each extending from a common origin at the left hand extremity of the connecting member 21 to respective flexible portions or hinges 18A,18B which join the straps to the collar 25. The two side straps serve to enhance the security and assist the alignment of the plugs 22,23 with the respective collars during reclosure.

In FIG. 4 the pull tab 30 is in the form of a solid piece of material extending laterally to a width greater than that of the connecting member 21 so that it is possible to use two fingers and so impose a greater lifting force on the tab to effect opening more easily.

Figure 6:
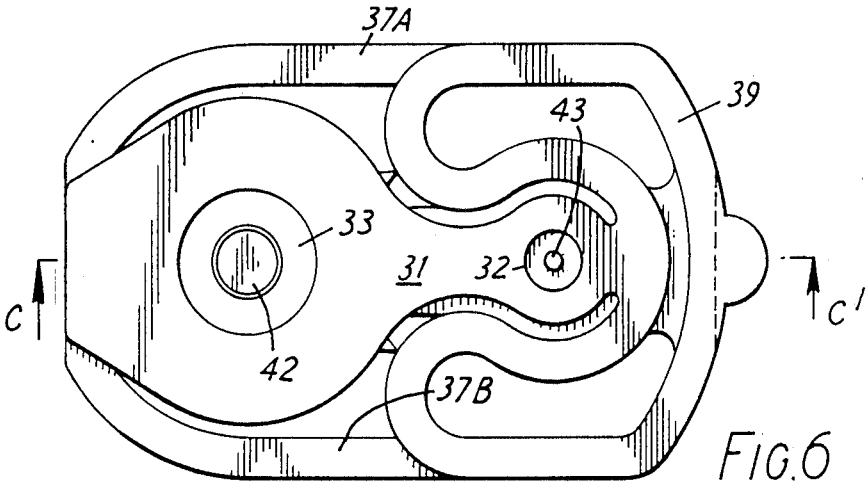
FIG. 6 is a plan view of a third embodiment of the closure of the invention.
Figure 8:
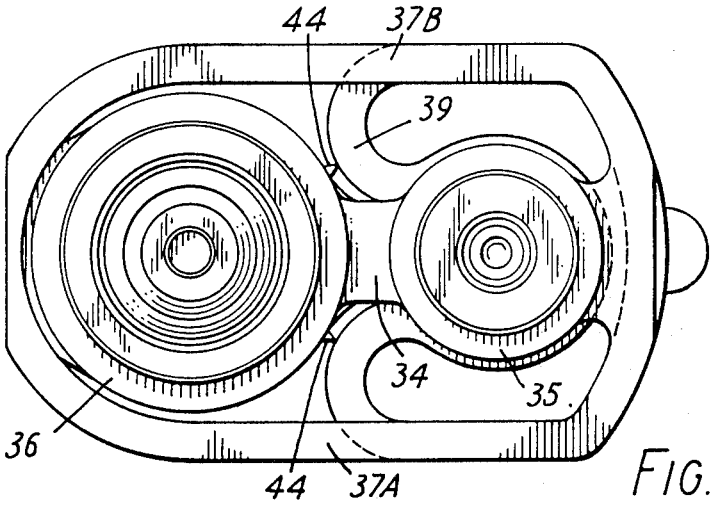
FIG. 8 is an underplan view of the closure of FIG. 6.

The third embodiment of the invention, as shown best in FIGS. 6 and 8, provides a relatively large pull tab 39 which extends laterally to each side of the venting plug 32 to make a loop which is easy to grip.

Figure 7:
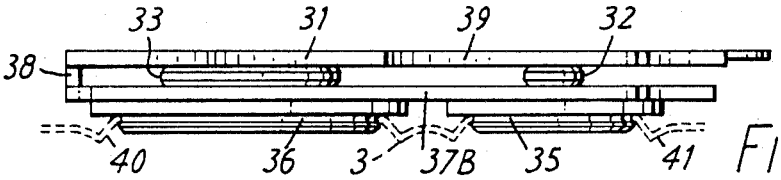
FIG. 7 is a side view of the closure of FIG. 6.

Referring to FIG. 7 it will be seen that a first connecting member 31 of the closure connecting the venting plug 32 and pouring plug 33 is extended to form the pull tab 39 and is connected by a common flexible portion 38 to a pair of side straps 37A,37B which extend to each side of a second connecting member 34 to connect the first connecting member 31 to the vent aperture collar 35, best seen in FIG. 8.

This arrangement of the side straps 37A,37B has the advantage that, when the closure is in position on the can end, the straps lie nearer to the surface of the can end where they are less vulnerable to accidental abuse.

In FIG. 7 part of a can end 3 is shown, by dashed lines, at a time just after the vent aperture collar 35 and the pouring aperture collar 36 have been entered into the respective apertures in the can end 3. Each aperture in the can end is defined by a frustoconical margin 40,41 of panel metal. The collars are sealingly engaged with the can end by flattening the frustoconical margins so that each marginal edge bites into the cylindrical outer surface of the respective collar. If desired the cylindrical outer surface of each collar may have a groove to receive the metal as is shown in FIG. 3. However such a groove is not essential.

Whilst the frustoconical margins 40,41 are depicted with their sharp edges upwards, an inverted frustoconical margin may alternatively be used.

Figure 9:
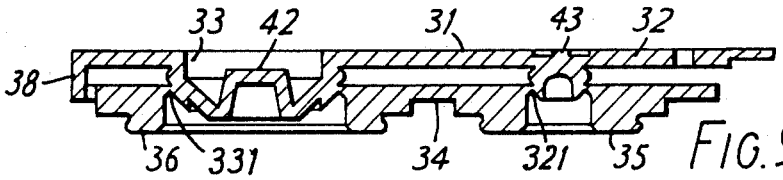
FIG. 9 is a section on line C–C′ in FIG. 6.

FIG. 9 shows that this third embodiment of the closure is moulded in one piece from a plastics material such as polyethylene, polypropylene or nylon. The pouring plug 33 is joined by a peripheral margin 331 of material of reduced thickness to the pouring aperture collar 36. The venting plug 32 is joined to the venting aperture collar 35 by a peripheral margin 321 of material of reduced thickness. Each plug 33,32 is shaped to be a snap fit in its respective collar 36,35 for reclosure after the margins of reduced thickness have been torn open on initial opening.

A boss 42 in the centre of pouring plug 33 is used as a first feeder position during moulding of the closure. A second feeding position at the centre of the venting plug 32 is indicated at 43.

The pull tab 39 is quite large and flexible. It may therefore be necessary to provide a pair of holding ties 44 such as are shown in FIG. 8 extending from the pouring aperture collar 36 to the lateral portions of the pull tab 39. Such holding ties serve to hold the pull tab neatly within the bounds of the closure. Rupture of ties 44 indicates that the closure has been tampered with. A particular advantage of the closure shown in FIGS. 6 to 9 is that it has two sides parallel which serve to give convenient guidance in automatic assembling machines used to fix the closure in a can end.

Figure 10:
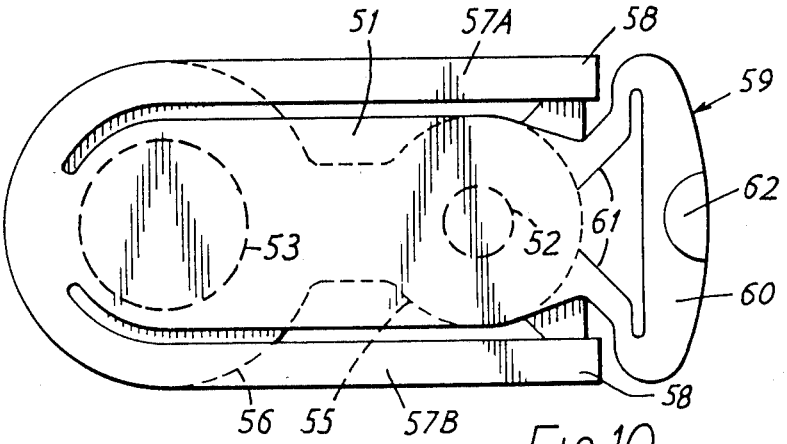
FIG. 10 is a plan view of a fourth embodiment of the closure of the invention.
Figure 11:
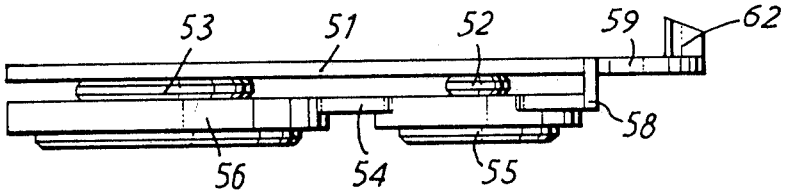
FIG. 11 is a side view of the closure of FIG. 10.
Figure 12:
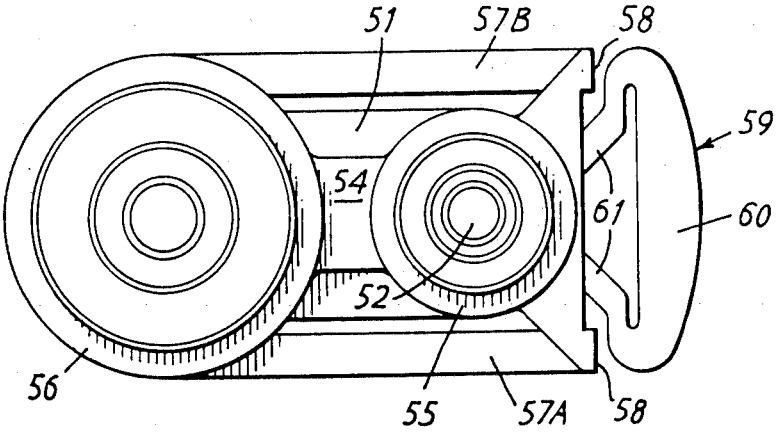
FIG. 12 is an underplan view of the closure of FIG. 10.

However, FIGS. 10 to 12 show a fourth embodiment of the closure which gives the same convenient parallel sides but uses less plastics material. As in the second embodiment described by reference to FIGS. 4 and 5, the fourth embodiment comprises a first connecting member 51 connecting a vent plug 52 and a pouring plug 53 and extended to form a pull tab 59; a second connecting member 54 connecting a pouring aperture collar 56 to a venting aperture collar 55; and a pair of straps 57A,57B at the level of the first connecting member 51 which connect the pouring plug 53 to respective flexible hinges 58 which join the venting aperture collar 55. Comparing FIG. 12 with FIG. 8 it will be seen that the collar portions 55,56, 35,36 are equal in size but the overall width of the closure in FIG. 12 is much less.

In FIGS. 10,11 and 12 the pull tab 59 can be seen to comprise a lateral portion 60 wider than the connecting member 51 and a pair of connecting webs 61 which converge at the venting plug 52, said lateral portion 60 and connecting webs 61 defining a substantially triangular aperture. This arrangement of tab permits a comfortable grip between first finger and thumb. A buttress, such as that denoted at 62, may be provided to enhance the grip.

From the foregoing description it will be understood that the various elements described such as pull tabs, collar fixing means and plug reclosure means each have some advantage and may therefore be used to replace corresponding elements in the embodiments other than the one in which they have been specifically described. For example the pull tab of FIGS. 10 to 12 may be used instead of the pull tab 29 in FIGS. 4 or 7 in FIG. 2. Alternatively the snap fit collars 35,36 of FIG. 9 may be replaced by the cylindrical collars 19 of FIG. 3.

We claim:

1. A closure for a container of the kind having a pouring aperture and a venting aperture in one end of the container, said closure being moulded in one piece of plastics material and comprising respective annular collar portions adapted to fit tightly within the said apertures, and respective plugs each attached by a rupturable section of the plastics material to the mouth of its annular collar portion to seal the respective aperture, each plug being shaped so that, after breaking of the rupturable section to open the aperture, the plug can be forced back into the collar portion to re-seal the aperture, the two plugs being connected to one another by a connecting member which is flexibly connected to one of the collar portions so as to retain the plugs after opening of the apertures, wherein the connecting member is extended beyond the vent plug to form a pull tab, which is thereby connected directly to the vent plug and through the connecting member to the pouring aperture plug, and the flexible connection of the connecting member to the said one collar portion is provided by flexible tie means extending from a side or sides of the pouring aperture plug to the said one collar portion.

2. A closure according to claim 1, wherein the tie means comprise a single flexible tie strap extending from the pouring aperture plug along one side of the connecting member to a hinge integral with the said collar portion.

3. A closure according to claim 2, wherein the tie means further comprises a second flexible tie strap extending from the pouring aperture plug along the other side of the connecting member to a second hinge integral with the said collar portion.

4. A closure according to claim 1, wherein the tie means comprise a hinge portion depending from the side of the pouring aperture plug distant from the pull tab and at least one strap portion extending from the hinge below the level of the connecting member to join the venting aperture collar portion.

5. A closure according to claim 1, wherein a second connecting member is provided, below the first connecting member and connecting adjacent sides of the two collar portions together.

6. A closure according to claim 1, wherein each collar portion has a cylindrical outer surface for engagement within a respective aperture in the metal of the can end.

7. A closure according to claim 6, wherein each collar portion is formed with a groove in its cylindrical outer surface to receive the metal of a can end formed to engage with it.

8. A closure according to claim 1, wherein the pull tab extends laterally to a greater width than the connecting member.

9. A closure according to claim 8, wherein the pull tab has an aperture therein.

10. A closure according to claim 8, wherein the tab extends laterally to form a pair of side pieces located one to each side of the vent plug portion.

* * * * *